US007175215B2

(12) United States Patent
Harris

(10) Patent No.: US 7,175,215 B2
(45) Date of Patent: Feb. 13, 2007

(54) EATING UTENSILS HAVING INTERNAL CHAMBERS STORING LIQUID CONDIMENTS

(76) Inventor: Charles A. Harris, 136 Hancock St., San Francisco, CA (US) 94114

( * ) Notice: Subject to any disclaimer, the term of this patent is extended or adjusted under 35 U.S.C. 154(b) by 15 days.

(21) Appl. No.: 10/989,061

(22) Filed: Nov. 15, 2004

(65) Prior Publication Data

US 2005/0116482 A1 Jun. 2, 2005

Related U.S. Application Data

(60) Provisional application No. 60/519,898, filed on Nov. 14, 2003.

(51) Int. Cl.
*A47G 21/10* (2006.01)

(52) U.S. Cl. ..... 294/1.1; 30/125

(58) Field of Classification Search ..... 294/1.1, 294/99.2; 30/125, 141, 322, 324; 16/111.1
See application file for complete search history.

(56) References Cited

U.S. PATENT DOCUMENTS

| | | | | | |
|---|---|---|---|---|---|
| 1,317,691 | A | * | 10/1919 | Fields | 30/125 |
| 1,754,973 | A | * | 4/1930 | Walch | 30/125 |
| 2,711,339 | A | | 6/1955 | McGogy | |
| 3,937,510 | A | | 2/1976 | Lew | |
| D283,192 | S | | 4/1986 | Kono | |
| 4,707,922 | A | | 11/1987 | Hosak-Robb | |
| 4,830,222 | A | * | 5/1989 | Read | 222/106 |
| 4,841,637 | A | * | 6/1989 | Scholzen | 30/125 |
| 4,888,188 | A | * | 12/1989 | Castner et al. | 426/109 |
| D311,851 | S | | 11/1990 | Allardyce | |
| 5,056,841 | A | | 10/1991 | Yong | |
| 5,277,464 | A | | 1/1994 | Okun | |
| 5,431,465 | A | | 7/1995 | Shibata | |
| 5,491,895 | A | * | 2/1996 | Lee | 30/125 |
| 5,785,238 | A | | 7/1998 | Tai | |
| 5,873,167 | A | * | 2/1999 | Mason | 30/125 |
| 5,975,305 | A | * | 11/1999 | Barger | 206/572 |
| D433,883 | S | | 11/2000 | Wei | |
| D445,312 | S | | 7/2001 | Shulman | |
| D446,425 | S | | 8/2001 | Wei | |
| 6,279,233 | B1 | * | 8/2001 | Cameron | 30/125 |
| D448,627 | S | | 10/2001 | Chan | |
| 6,328,360 | B1 | | 12/2001 | Freeman | |
| 6,402,214 | B1 | | 6/2002 | Weiner | |
| D463,220 | S | | 9/2002 | Yun | |
| 6,454,328 | B1 | | 9/2002 | Barillos | |
| D474,653 | S | | 5/2003 | Stewart | |

(Continued)

FOREIGN PATENT DOCUMENTS

| | | |
|---|---|---|
| JP | 975199 | 3/1997 |

(Continued)

*Primary Examiner*—Dean J. Kramer
(74) *Attorney, Agent, or Firm*—Eric Karich

(57) ABSTRACT

An eating utensil includes an elongate hollow body having a proximal end and a closed distal end. The elongate hollow body defines an internal chamber, and has an aperture adjacent the proximal end. The aperture is in communication with the internal chamber. A liquid condiment is contained within the internal chamber. A seal member is bonded to a lip of the body about the aperture. The seal member contains the liquid condiment within the internal chamber until the seal member is removed.

3 Claims, 5 Drawing Sheets

U.S. PATENT DOCUMENTS

| | | | |
|---|---|---|---|
| 6,581,997 | B1 | 6/2003 | Martikainen et al. |
| 6,607,225 | B1 | 8/2003 | Lai |

FOREIGN PATENT DOCUMENTS

| | | | |
|---|---|---|---|
| JP | 409252911 | A | 9/1997 |
| JP | 410155626 | A | 6/1998 |
| JP | 02000005024 | A | 1/2000 |
| JP | 02000197554 | A | 7/2000 |
| JP | 02000287811 | A | 10/2000 |
| JP | 02000333811 | A | 12/2000 |
| JP | 02000347610 | A | 12/2000 |
| JP | 02001000454 | A | 1/2001 |
| JP | 02001299552 | A | 10/2001 |
| JP | 2002177121 | A | 6/2002 |
| JP | 2003250684 | A | 9/2003 |

* cited by examiner

EATING UTENSILS HAVING INTERNAL CHAMBERS STORING LIQUID CONDIMENTS

CROSS-REFERENCE TO RELATED APPLICATIONS

This application for a utility patent claims the benefit of U.S. Provisional Application No. 60/519,898, filed Nov. 14, 2003. This application is incorporated herein by reference in its entirety.

STATEMENT REGARDING FEDERALLY SPONSORED RESEARCH

Not Applicable

BACKGROUND OF THE INVENTION

1. Field of the Invention

This invention relates generally to eating utensils and to condiments, and more particularly to eating utensils adapted to store condiments.

2. Description of Related Art

A conventional chopstick is generally a rod used as an eating utensil. Chopsticks are typically used in pairs, and may be considered the Oriental equivalent of the western fork.

The term "condiment" refers to a substance used to flavor or complement food. "Soy sauce" is a liquid condiment used throughout the world, and is very popular in Asia. Produced for thousands of years, soy sauce is a salty, brown, liquid made by fermenting soybeans and some type of roasted grain (wheat, barley, or rice are common) in brine.

SUMMARY OF THE INVENTION

The invention is an eating utensil that includes an elongate hollow body having a proximal end and a closed distal end. The elongate hollow body defines an internal chamber, and has an aperture adjacent the proximal end. The aperture is in communication with the internal chamber. A liquid condiment is contained within the internal chamber. A seal member is bonded to a lip of the body about the aperture. The seal member contains the liquid condiment within the internal chamber until the seal member is removed.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
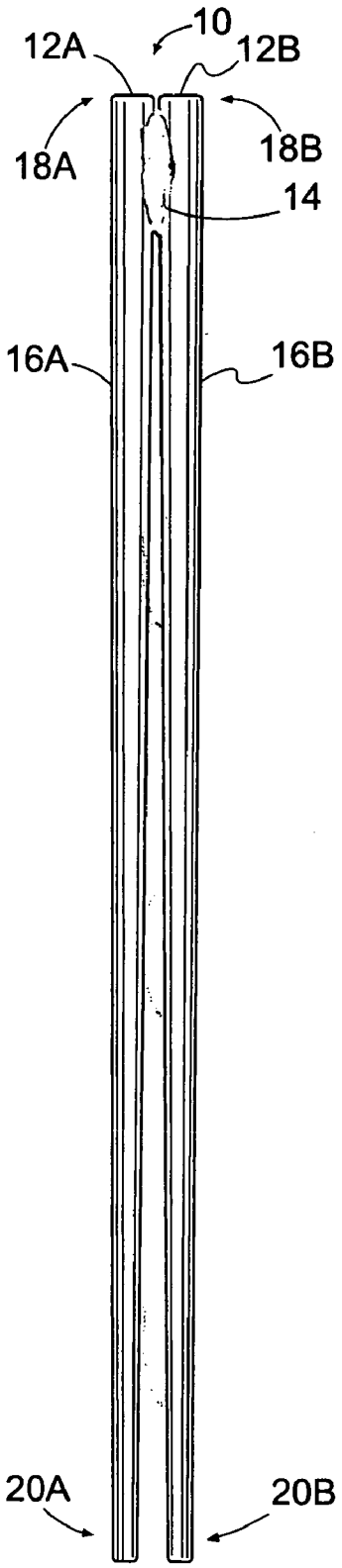
FIG. 1 is a perspective view of one embodiment of an eating utensil including a pair of chopsticks bonded together by a connector, wherein at least one of the chopsticks has an internal chamber containing a liquid condiment.

As shown in FIGS. 1–13, the invention is an eating utensil 10 that includes an elongate hollow body 16, a liquid condiment 36 in an internal chamber 34, and a seal member 40 bonded to a lip 32 of the body 16 about an aperture 30. The seal member 40 functions to contain the liquid condiment 36 within the internal chamber 34 until the seal member 40 is removed. The seal member 40 can be constructed of any functional material, including but not limited to plastic, foil, coated paper, or any other suitable material known to those skilled in the art. For purposes of this application, the term "bonded" shall mean any form of bonding such as with an adhesive, heat weld, or other form of attachment. It can also include the formation of a weakened portion that functions to attach the seal member 40 to the body 16 in a manner that allows removal, also including perforations or other similar attachments. Several embodiments of this general concept are described in greater detail below.

FIG. 1 is a perspective view of one embodiment of an eating utensil 10 including a pair of chopsticks 12A and 12B bonded together by a connector 14. As described in detail below, at least one of the chopsticks 12A and 12B has an internal chamber containing a liquid condiment (e.g., soy sauce). Breaking the connector 14 separates the chopsticks 12A and 12B and allows the liquid condiment to be dispensed.

In the embodiment of FIG. 1, the chopsticks 12A and 12B are substantially identical. The chopstick 12A has an elongate body 16A having a proximal end 18A and a distal end 20A.

Similarly, the chopstick 12B has an elongate body 16B having a proximal end 18B and a distal end 20B. In the embodiment of FIG. 1, the proximal ends 18A and 18B of the respective chopsticks 12A and 12B are bonded together by the connector 14.

It is noted that each of the chopsticks 12A and 12B is an eating utensil, and in combination form the eating utensil 10. Herein below, either one of the substantially identical chopsticks 12A and 12B will be referred to individually as "the chopstick 12," and the chopsticks 12A and 12B will be referred to collectively as "the chopsticks 12."

In the embodiment of FIG. 1, one or both of the chopsticks 12 may have an internal chamber containing the liquid condiment. In general, one of the chopsticks 12 having the internal chamber also has an aperture adjacent the proximal end 18 in communication with the internal chamber. Breaking the connector 14 allows the liquid condiment to be dispensed via the aperture.

In general, the chopsticks 12 are preferably made from a substantially rigid, non-toxic material. Suitable materials include non-toxic woods, plastics, and metals. In one embodiment, each of the chopsticks 12 is made of a semi-transparent plastic material such that the liquid condiment can be seen within the body 16.

Figure 2:
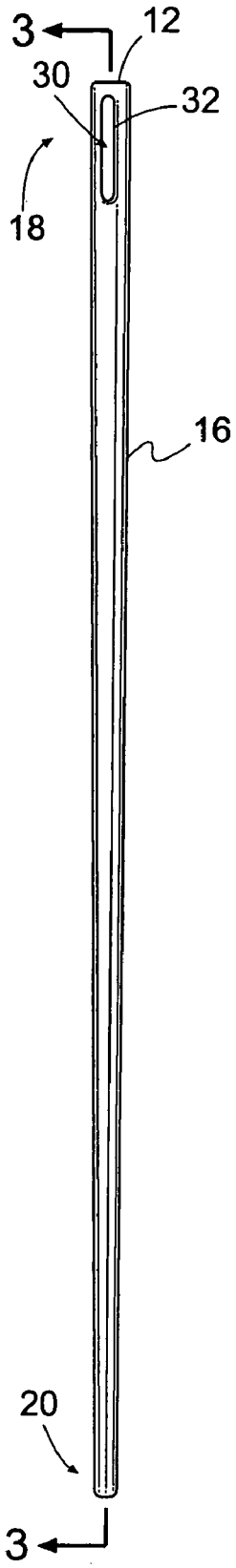
FIG. 2 is a perspective view of one of the chopsticks of FIG. 1.
Figure 3:
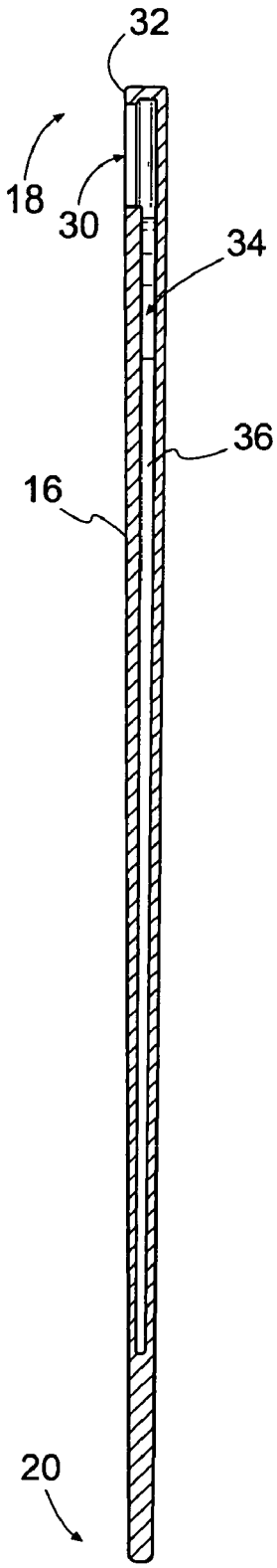
FIG. 3 is a cross section view of the chopstick of FIG. 2 as indicated in FIG. 2.

FIG. 2 is a perspective view of one of the chopsticks 12 of FIG. 1, and FIG. 3 is a cross section view of the chopstick 12 of FIG. 2 as indicated in FIG. 2. In the embodiment of FIGS. 2–3, the body 16 of the chopstick 12 is hollow and defines an internal chamber 34. An aperture 30 adjacent the proximal end 18 of the body 16 is coupled to, and communicates with, an internal chamber 34. A liquid condiment 36 (e.g., soy sauce) is contained within the internal chamber 34. In one embodiment, the internal chamber 34 is dimensioned to hold about 0.125 ounce of the liquid condiment.

In general, a seal member is bonded to a lip 32 of the body 16 about the aperture 30. As described in more detail below, the seal member functions to contain the liquid condiment 36 within the internal chamber 34 until the seal member is removed. For example, referring back to FIG. 1, the seal member includes the connector 14 used to connect the chopsticks 12 together.

Figure 4:
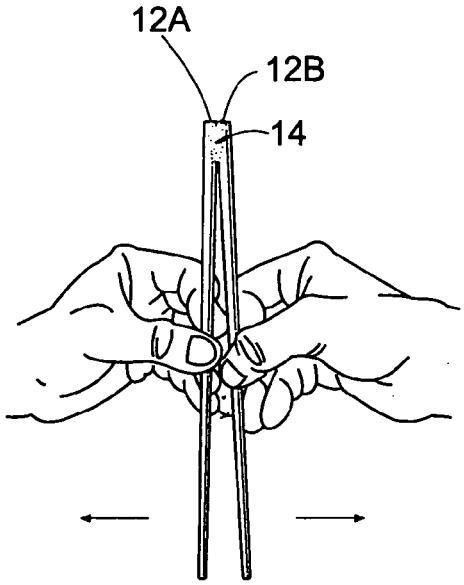
FIG. 4 is a perspective view of the chopsticks of FIG. 1 wherein the chopsticks are being pulled apart.
Figure 5:
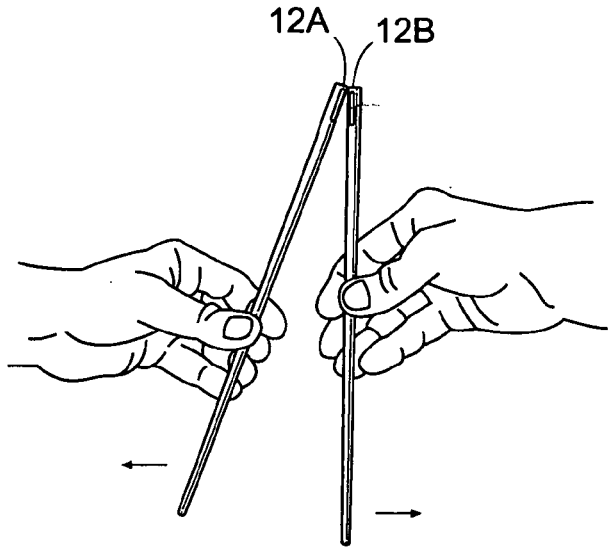
FIG. 5 is a perspective view of the chopsticks of FIG. 4 wherein the connector has been broken, separating the chopsticks.
Figure 6:
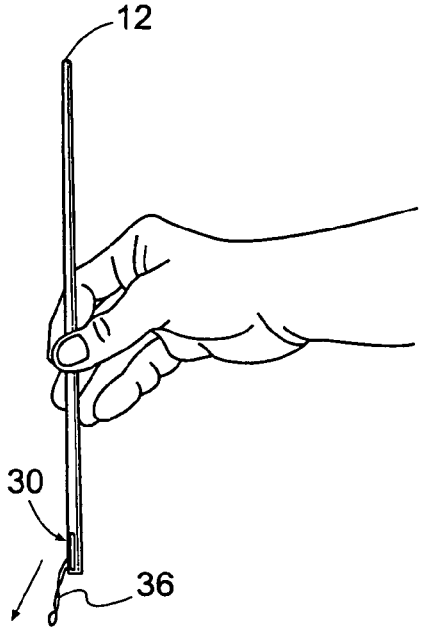
FIG. 6 is a perspective view of one of the chopsticks of FIG. 5 wherein the chopstick has been inverted, allowing the liquid condiment to flow out of the internal chamber via an aperture.
Figure 7:
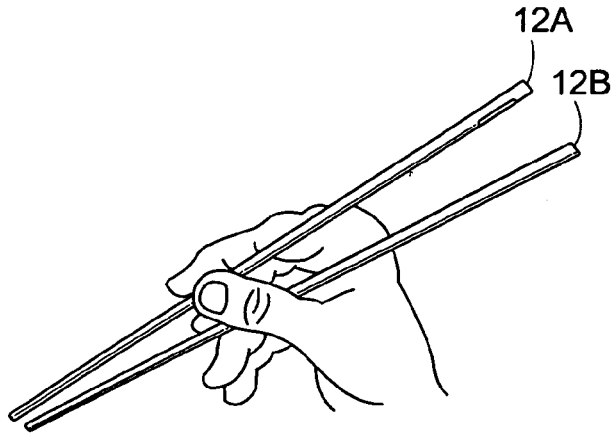
FIG. 7 is a perspective view of the chopsticks of FIGS. 4–5 wherein a hand of a user is grasping the chopsticks in the conventional manner in order to use the chopsticks as eating utensils.

FIGS. 4–7 will now be used to describe the separating of the chopsticks 12A and 12B of FIGS. 1–3 in order to dispense the liquid condiment 36 contained in one or both of the chopsticks 12. FIG. 4 is a perspective view of the chopsticks 12 of FIG. 1 wherein the chopsticks 12 are being pulled apart. FIG. 5 is a perspective view of the chopsticks 12 of FIG. 4 wherein the connector 14 has been broken, separating the chopsticks 12. FIG. 6 is a perspective view of one of the chopsticks 12 of FIG. 5 wherein the chopstick 12 has been inverted, allowing the liquid condiment 36 to flow out of the internal chamber via the aperture 30 and thereby dispensed. FIG. 7 is a perspective view of the chopsticks 12 of FIGS. 4–5 wherein a hand of a user is grasping the chopsticks 12 in the conventional manner in order to use the chopsticks 12 as eating utensils.

Figure 8:
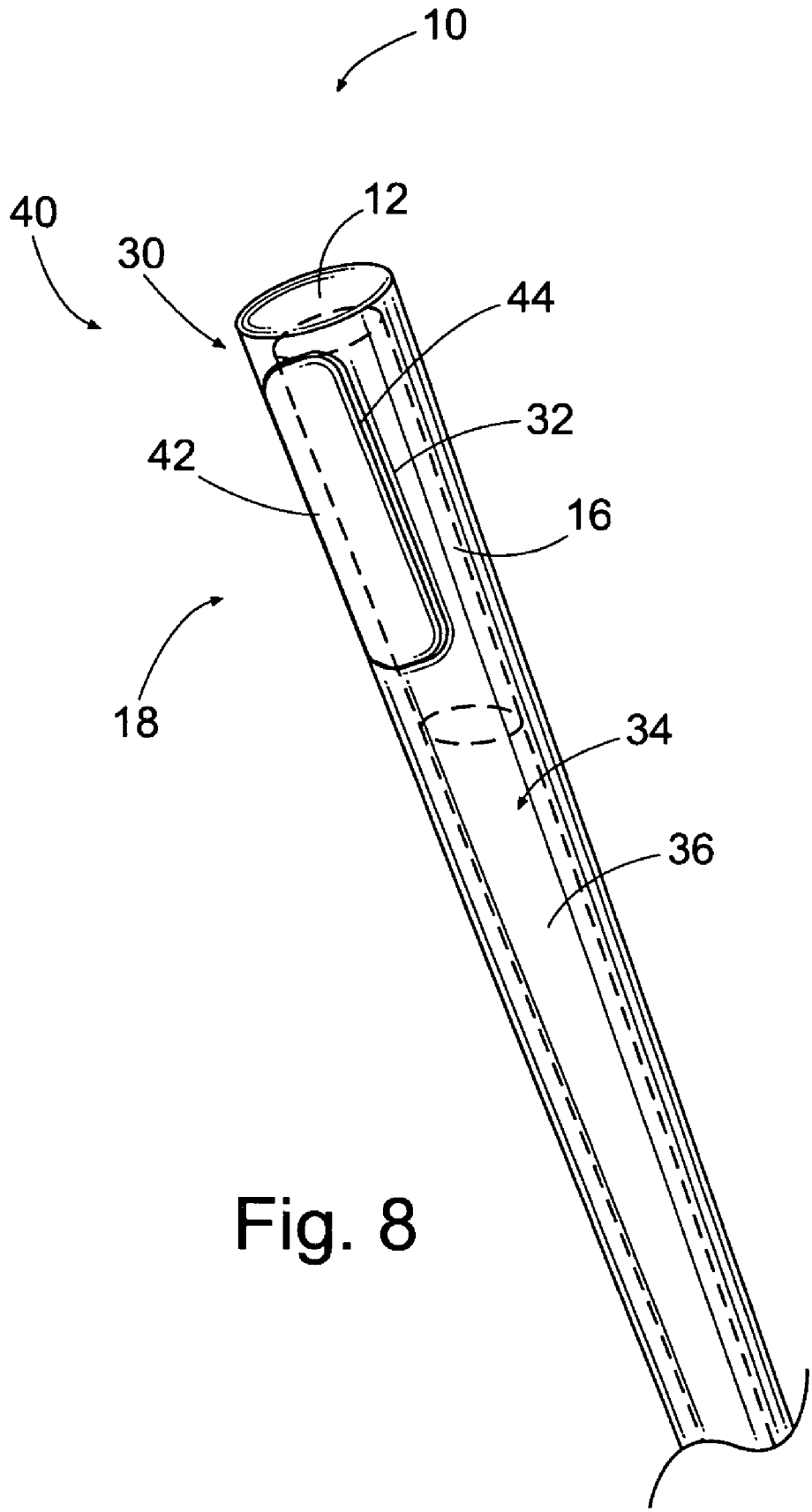
FIG. 8 is a perspective view of a portion of another embodiment of the eating utensil of FIG. 1 wherein the eating utensil includes one of the chopsticks of FIG. 1, and wherein the chopstick includes the internal chamber containing the liquid condiment.

FIG. 8 is a perspective view of a portion of another embodiment of the eating utensil 10 of FIG. 1 wherein the eating utensil 10 includes one of the chopsticks 12 of FIG. 1. In the embodiment of FIG. 8, the chopstick 12 may or may not be connected to another chopstick.

In the embodiment of FIG. 8, the chopstick 12 includes the internal chamber 34 storing the liquid condiment 36, and the aperture 30 in communication with the internal chamber 34. (See FIGS. 2–3). The seal member is labeled "40," and includes a tab 42 positioned within the aperture 30 of the body 16. (See FIGS. 2–3.) The tab 42 is bonded to the lip 32 surrounding the aperture 30 (see FIGS. 2–3) via a thinned region 44. In general, the thinned region 44 is adapted to be ruptured when pressure is applied to the tab 42. The tab 42 and the thinned region 44 form a liquid tight seal. In one embodiment, the body 16, the tab 42, and the thinned region 44 are formed from the same material.

For example, the tab 42 and the thinned region 44 may be formed when the body 16 is formed. In this situation, the liquid condiment 36 may be injected into the internal chamber 34, and the holes used to inject the liquid condiment 36 may then be closed (e.g., by heat sealing). Alternately, after the liquid condiment 36 is introduced into the internal chamber 34 via the aperture 30, the tab 42 may be bonded into the aperture 30 using a heat sealing process that forms the thinned region 44.

In the embodiment of FIG. 8, the liquid condiment 36 contained within the internal chamber 34 may be dispensed, for example, by pressing on the tab 42 using an end of another chopstick to rupture the thinned region 44, then inverting the chopstick 12 such that the liquid condiment 36 flows out of the internal chamber 34 via the aperture 30.

Figure 9:
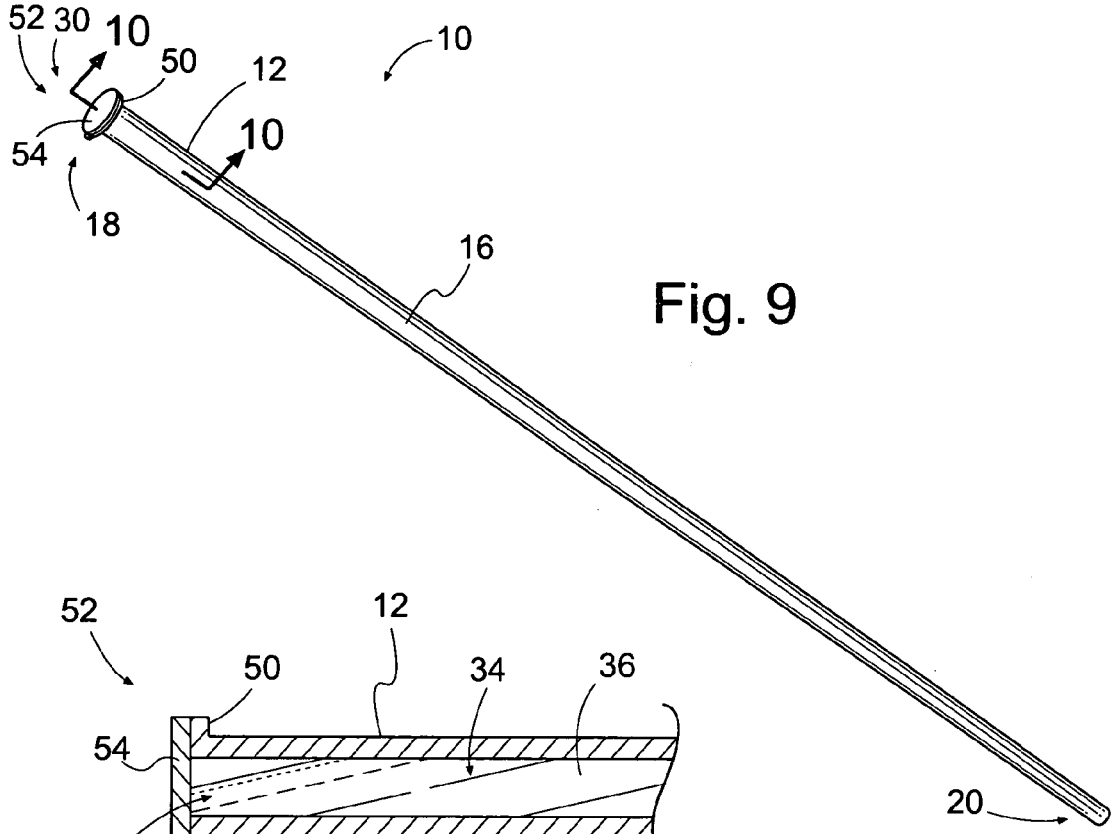
FIG. 9 is a perspective view of a third embodiment of the eating utensil of FIG. 1 wherein the eating utensil includes one of the chopsticks of FIG. 1, wherein the chopstick includes the internal chamber containing the liquid condiment.

FIG. 9 is a perspective view of a third, preferred embodiment of the eating utensil 10 of FIG. 1 wherein the eating utensil 10 includes one of the chopsticks 12 of FIG. 1. In the embodiment of FIG. 9, the chopstick 12 includes the internal chamber 34 storing the liquid condiment 36, and the aperture 30 in communication with the internal chamber 34. (See FIGS. 2–3). The chopstick 12 may or may not be connected to another chopstick.

In the embodiment of FIG. 9, the aperture 30 is in the proximal end 18 of the body 16, and the lip 32 of the body 16 (see FIGS. 2–3) comprises a flange 50. The seal member is labeled "52," and includes a tab 54 having a perimeter bonded (e.g., adhesively bonded) to the flange 50. The tab 54 may be a foil or paper seal, or other form of seal member known to those skilled in the art. In alternative embodiments, however, the flange 50 is not required, particularly when the sidewall of the body 16 is thick enough to receive the tab 54.

Figure 10:
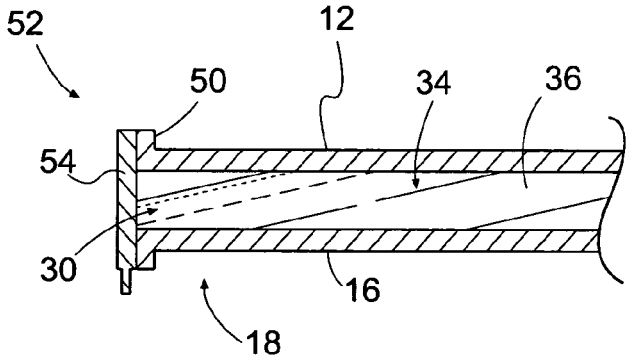
FIG. 10 is a cross section view of a portion of the eating utensil of FIG. 9 as indicated in FIG. 9.
Figure 11:
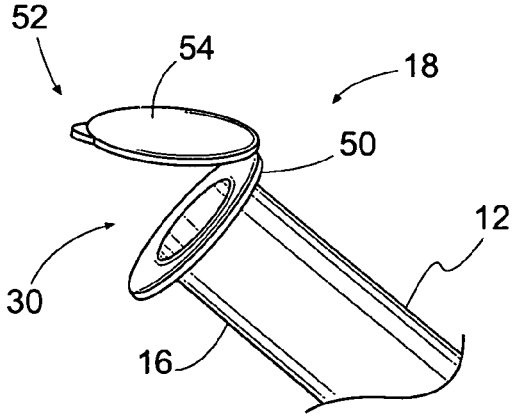
FIG. 11 is a perspective view of the eating utensil of FIG. 9 wherein a portion of a tab has been pulled away from a flange, thereby allowing a liquid condiment stored in an internal chamber to be dispensed.

FIG. 10 is a cross section view of a portion of the eating utensil 10 of FIG. 9 as indicated in FIG. 9. FIG. 11 is a perspective view of the eating utensil 10 of FIG. 9 wherein a portion of the tab 54 has been pulled away from the flange 50, thereby allowing the liquid condiment to be dispensed. In the embodiments of FIGS. 9–11, the tab 54 is dimensioned to cover the aperture 30 and the surrounding flange 50. The tab 54 is preferably formed from a flexible, liquid impervious material.

Figure 12:
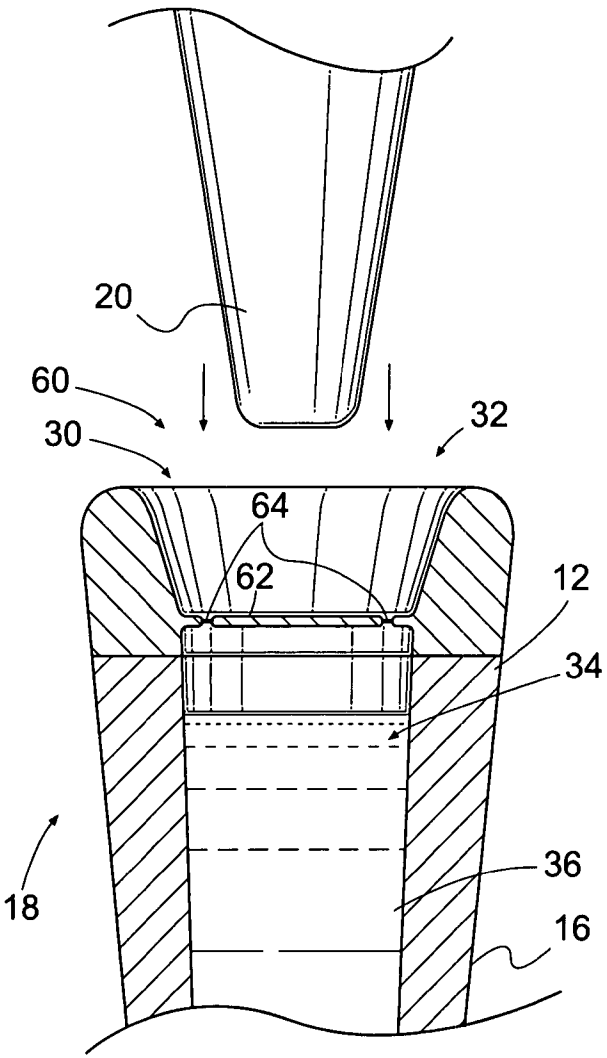
FIG. 12 is a perspective view of a portion of a fourth embodiment of the eating utensil of FIG. 1 wherein the eating utensil includes one of the chopsticks of FIG. 1, and wherein the chopstick includes the internal chamber containing the liquid condiment.

FIG. 12 is a perspective view of a portion of a fourth embodiment of the eating utensil 10 of FIG. 1 wherein the eating utensil 10 includes one of the chopsticks 12 of FIG. 1. In the embodiment of FIG. 12, the chopstick 12 includes the internal chamber 34 storing the liquid condiment 36, and the aperture 30 in communication with the internal chamber 34. (See FIGS. 2–3). The chopstick 12 may or may not be connected to another chopstick. As in FIG. 9, the aperture 30 is in the proximal end 18 of the body 16.

In the embodiment of FIG. 12, the seal member is labeled "60," and includes a disc-shaped tab 62 positioned within the aperture 30 of the body 16. The tab 62 is bonded to the lip 32 surrounding the aperture 30 via a thinned region 64. The thinned region 64 is adapted to be ruptured when pressure is applied to the tab 62. The tab 62 and the thinned region 64 form a liquid tight seal. In one embodiment, the body 16, the tab 62, and the thinned region 64 are formed from the same material.

For example, the tab 62 and the thinned region 64 may be formed when the body 16 is formed. In this situation, the liquid condiment 36 may be injected into the internal chamber 34, and the holes used to inject the liquid condiment 36 may then be closed (e.g., by heat sealing). Alternately, after the liquid condiment 36 is introduced into the internal chamber 34 via the aperture 30, the tab 62 may be bonded into the aperture 30 using a heat sealing process that forms the thinned region 64.

In the embodiment of FIG. 12, the liquid condiment 36 contained within the internal chamber 34 may be dispensed, for example, by pressing on the tab 62 using an end of another chopstick to rupture the thinned region 64, then inverting the chopstick 12 such that the liquid condiment 36 flows out of the internal chamber 34 via the aperture 30. In this embodiment, the distal end 20 of another chopstick 12 may be used to pierce the tab 62 for dispensing the liquid condiment 36.

Figure 13:
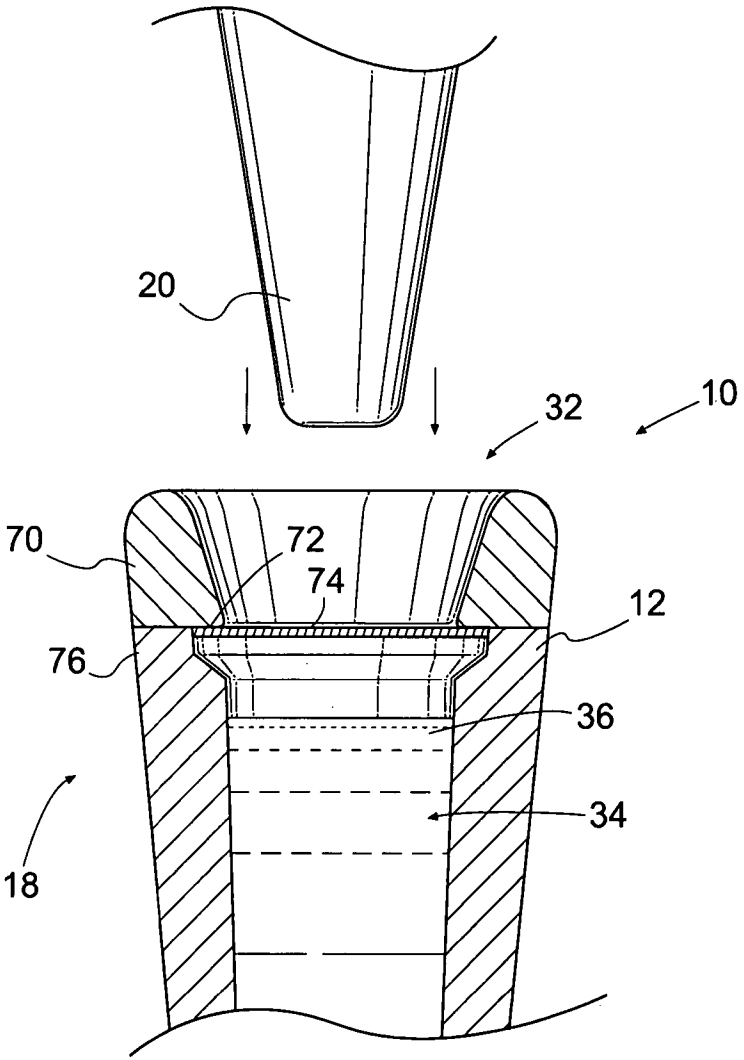
FIG. 13 is a perspective view of a portion of a fifth embodiment of the eating utensil of FIG. 1 wherein the eating utensil includes one of the chopsticks of FIG. 1, and wherein the chopstick includes the internal chamber containing the liquid condiment.

In the embodiment of FIG. 13, an annular cap 70 includes an inwardly extending portion 72 that includes a foil seal 74 or similar seal member. The annular cap 70 is bonded to the top rim 76 of the chopstick 12, preferably with an adhesive or with a heat weld. As with FIG. 12, the distal end 20 of another chopstick 12 may be used to pierce the foil seal 74 for dispensing the liquid condiment 36.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A chopstick, comprising:

an elongate hollow body having a proximal end and a closed distal end, the elongate hollow body defining an internal chamber and having a top rim defining an aperture adjacent the proximal end communicating with the internal chamber;

a liquid condiment in the internal chamber;

an annular cap having an inwardly extending portion, the annular cap being banded to the top rim of the elongate hollow body; and a seal member attached to the inwardly extending portion so as to cover the aperture, the seal member being adapted to be ruptured when pressure is applied to the seal member, for dispensing the liquid condiment.

2. The chopstick of claim 1, wherein the seal member is a foil seal.

3. The chopstick of claim 1, wherein the seal member includes an annular thinned region, and the thinned region is ruptured when pressure is applied to the seal member.

* * * * *